US006284392B1

(12) United States Patent
Seth et al.

(10) Patent No.: US 6,284,392 B1
(45) Date of Patent: Sep. 4, 2001

(54) SUPERALLOYS WITH IMPROVED WELDABILITY FOR HIGH TEMPERATURE APPLICATIONS

(75) Inventors: Brij B. Seth, Orlando, FL (US); Easo P. George, Oak Ridge, TN (US); Sudarsanum S. Babu, Oak Ridge, TN (US); Gene M. Goodwin, Oak Ridge, TN (US); Stanislaus A. David, Oak Ridge, TN (US); Carol E. Moyer, Centreville, VA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/372,693

(22) Filed: Aug. 11, 1999

(51) Int. Cl.[7] ..... B32B 15/01; C22C 19/05

(52) U.S. Cl. ..... 428/680; 148/410; 148/419; 148/428; 148/442; 415/902; 416/241 R; 420/447; 420/448; 420/449; 420/450; 420/454; 420/580; 420/588; 428/637

(58) Field of Search ..... 428/637, 680; 420/447, 448, 449, 450, 454, 580, 588; 148/410, 419, 428, 442; 415/902; 416/241 R

(56) References Cited

U.S. PATENT DOCUMENTS

| | | | | |
|---|---|---|---|---|
| 3,166,412 | | 1/1965 | Bieber | 420/447 |
| 3,898,109 | | 8/1975 | Shaw | 148/501 |
| 4,039,330 | | 8/1977 | Shaw | 420/448 |
| 4,219,592 | | 8/1980 | Anderson et al. | 427/405 |
| 4,810,467 | * | 3/1989 | Wood et al. | 420/448 |
| 5,330,711 | * | 7/1994 | Snider | 420/448 |
| 5,480,283 | | 1/1996 | Doi et al. | 415/199.5 |

FOREIGN PATENT DOCUMENTS 0302302 7/1988 (EP) .

OTHER PUBLICATIONS

"Development of a New Hot–Cracking Test–The Sigmajig"; *Welding Research Supplement*, pp 33–s to 38–s (Feb. 1987); G.M. Goodwin.

* cited by examiner

*Primary Examiner*—Deborah Jones
*Assistant Examiner*—Robert R. Koehler

(57) ABSTRACT

A cast nickel-base superalloy component (10) is made having a composition containing small amounts of both boron and zirconium which are effective in combination to provide increased weldability, where such alloy is adapted for welding by weld (18) to a second superalloy piece, where the two pieces are firmly bonded together and have a Sigmajig transverse stress value (16) greater than 137.9 million Newtons per square meter.

10 Claims, 1 Drawing Sheet

SUPERALLOYS WITH IMPROVED WELDABILITY FOR HIGH TEMPERATURE APPLICATIONS

GOVERNMENT CONTRACT

The Government of the United States of America has rights in this invention pursuant to Contract No. DE-FC21-95MC32267, awarded by the United States Department of Energy. Work also done under ORNL Work for Others contract ERD-96-1377.

BACKGROUND OF THE INVENTION

1. Field of the Invention

This invention relates to improving the weldability of Ni-based superalloys so that they can be fabricated and repaired without extensive cracking, using conventional welding processes. These superalloys are used in turbine vanes and other structural components in combustion turbines and the like.

In many applications, Co based alloys are used, because of the difficulty in fabricating and repairing nickel based superalloys. But Co is costly and is considered a strategic material whose future supply may be uncertain and limited, so it is important to find weldable nickel-base superalloys that can replace cobalt-base superalloys.

2. Background Information

Cobalt or nickel based, so called high temperature "superalloys", usually containing Cr, Al, Ti and Mo, among other component elements, are well known and have been used for years in making turbine blades and vanes for high performance gas turbines. At the higher operating stresses and temperatures for forthcoming gas turbines, Co base alloys either would not meet design requirements for creep strength, or would require additional cooling, with a corresponding cost of lower overall efficiency of the gas turbine system. Development of other alloys for use in applications now filled by Co base alloys is desirable for reasons of both cost and performance.

U.S. Pat. No. 4,039,330 (Shaw) teaches nickel base, Ni·Cr·Co superalloys having wt % compositional ranges of: Cr=22.4–24.0; Co=7.4–15.4; C=0.13–0.17; Mo=0.1–3.15; W=1.85–4.0; Nb=0.2–2.0; Ta=1.05–2.8–4.3; Al=1.39–2.19; Zr=0.09–0.22 and B=0.008–0.011, with the balance being Ni. Nickel base superalloys are, however, limited in their application in turbine vanes and the like because of low weldability. Weldability is an essential and critical material requirement impacting the ability to repair casting defects, fabrication of component assemblies requiring welding, and the repair of components damaged in service.

U.S. Pat. No. 3,898,109 (Shaw) teaches a high-strength, corrosion resistant superalloy that is currently in use in some gas turbines. It has wt % compositional ranges of: Cr=22.0–22.8; Co=18.5–19.5; C=0.13–0.17; Mo=0; W=1.8–2.2; Nb=0.9–1.1; Ta=1.3–1.5; Ti=3.6–3.8; Al=1.8–2.0; Zr=0.04–0.012, and B=0.004–0.012, with the balance being Ni. This superalloy is sold under the Trade Name "IN-939". While this superalloy meets many of the demands of turbine vane applications, its utility is reduced by its limited weldability. There is a need, therefore, to optimize the weldability properties of nickel base superalloys for gas turbine applications, while avoiding detrimental effects on material strength, stability and other properties. Co-base superalloys have the advantage that they have relatively good weldability compared to Ni-base superalloys. This property is important to operators of land-based gas turbines because repair welds often have to be made to extend component service life. In addition, repair welds have to be made in the foundry on as-cast vanes and vane segments to meet quality requirements, and fabrication welds are needed for assembly of components.

U.S. Pat. No. 3,166,412 (Bieber) is an early teaching of cast nickel-based superalloys suitable for the production of gas turbine rotors. About 10 wt %–14 wt % Cr and at least 0.005 wt % B and 0.02 wt % Zr were thought important for strength and ductility while 5 wt %–7 wt % Al, 0.5 wt %–1.5 wt % Ti and 1 wt %–3 wt % (Columbium) Niobium-Nb were thought important as hardening and strengthening elements.

U.S. Pat. No. 5,480,283 (Doi et al.) teaches Ni based superalloys with high Co concentration having improved weldability, containing in wt %: Cr=15–25; Co=20–25; C=0.05–0.20; W=5–10; Ti=1.0–3.0; Al=1.0–3.0, with the balance being primarily Ni. B is not required, but if used can be present in the range of 0.001–0.03 wt %. Zr, in the range of 0–0.05 wt %, is mentioned only as adding to high temperature strength, as is B. Their Sample 6, which has improved creep rupture strength, contains 0.009 wt % B plus 0.03 wt % Zr. They equate good weldability to the proper combination of Al+Ti at less than 5.0 wt %. FIG. 2 of that patent shows Al+Ti content vs length of weld cracks, with the best Samples being 2–5 and 13, none of which contain Zr. One of the worst Samples contained B=0.010 wt % and Zr=0.11 wt %—Sample 1. U.S. Pat. No. 5,330,711 (Snider) also teaches, generally, that good weldability depends on the inclusion of substantial amounts of Mo, a low Al/Ti ratio, and a low Al+Ti content to provide a low gamma prime volume fraction and a more ductile alloy, better able to accommodate stresses produced during the weld thermal cycle. Their best test Samples—as far as weldability goes were: B (prior art) and RS5. Those samples had B 0 wt %; Zr=0 wt %; Mo=3.1 wt % for Sample B and B=0.005 wt %; Zr=0.01 wt % and Mo=4.9 wt % for Sample RS5.

A patent directly related to turbine superalloys that are alloy repair weldable is EPA 0302302Al (Wood et al.), where the preferred compositional wt % range of the alloy was: Cr=22.2–22.8; Co=18.5–19.5; C=0.08–0.12; W=1.8–2.2; Nb=0.7–0.9; Ta=0.9–1.1; Ti=2.2–2.4; Al=1.1–1.3; Zr=0.005–0.02; and B=0.005–0.015, where Al+Ti=3.2–3.8 wt %, with the remainder essentially nickel. The combination of C+Zr were carefully balanced to increase castability and the content of Ti+Al+Ta+Nb was reduced to increase ductility.

U.S. Pat. No. 4,219,592 (Anderson et al.) relates to a fusion welding double surfacing process for crack prone superalloys used in gas turbine engines, where a first surface layer helps prevent such cracking. The crack resistant layer had a wt % composition of: Cr=14–22; Co=5–15; Mo=0–8; Ti=0.5–4; Al=0.7–3; Mn=0.5–3; Zr=0–0.1; and B=0–0.05 where Al+Ti is greater than 3 wt %, the balance being Ni. Weld crack resistance was attributed to substantial Mn inclusion.

While weldable Ni base superalloys are known, weldability is currently achieved by sacrificing the high temperature strength. There is a need for nickel base superalloys which can be welded by conventional technology without sacrificing castability, high temperature strength, stability and creep ductibility.

SUMMARY OF THE INVENTION

Therefore, it is a main object of this invention to provide such Ni base superalloys having even more improved weldability, without compromising other mechanical properties.

These and other objects of the invention are met by providing a high temperature resistant nickel base superalloy composition containing small amounts of both boron and zirconium which are effective in combination to provide increased weldability. Preferably, the range of boron in the composition is from 0.001 wt % to 0.005 wt. % and the range of zirconium is from 0.005 wt % to 0.05 wt %. The invention also resides in a high temperature resistant, nickel-base superalloy adapted for welding comprising the composition by weight percent: 20.0%–25% Cr; up to 19.5% Co; 3.4%–4.0% Ti; 1.6%–2.2% Al; 0.005%–0.05% Zr; 0.001%–0.005% B, with the balance substantially Ni.

Preferably Al+Ti is from 5.0%–6.2%. Preferably the high temperature resistant nickel-based creep resistant superalloy, which is adapted for welding, essentially consists of the composition by weight percent: 22.0%–23.0% Cr; up to 19.5% Co; 3.4%–4.0% Ti; 1.6%–2.2% Al; 1.6%–2.4% W; 1.2%–1.6% Ta; 0.8%–1.2% Nb; 0.005%–0.050% Zr; 0.001%–0.005% B; where Al+Ti is from 5.0%–6.2%; and Zr+B is from 0.005% to 0.06%, with the balance Ni.

These superalloys are repair weldable, ductile, capable of being cast in large cross sections, and require minimal heat treatment. The alloy preferably will have a Sigmajig transverse stress value $\sigma_0$ of greater than 20,000 psi or 137.9 million Newtons per square meter. This stress value is defined by G. M. Goodwin in *Welding Research Supplement*, vol. 66(2), pp 33-s to 38-s (February 1987), herein incorporated by reference. Goodwin states, on p. 34-S, that the Sigmajig stress value can be determined using a Sigmajig test fixture: "The fixture holds a 50-×50-mm (2-×2-in) square specimen between hardened steel grips and applies a transverse stress, stigma, prior to welding. Larger specimens can be used if desired. The load is applied by a pair of strain-gaged bolts and maintained by stacks of Bellville washers in the load train. This approach avoids the inherent limitations of applying dead-weight loads . . . in that the washers provide an adjustable spring constant. The loading system was calibrated with strain-gaged specimens; it has a repetition accuracy of ±0.1% and a resolution of 1 lb (0.45 kg) of load . . . After preloading, an autogenous gas tungsten arc (GTA) weld is produced along the specimen centerline using a welding current of 20 A DCEN, an arc length of 0.88 mm (0.034 in.), and a travel speed of 15 mm/s (0.6 in./s). As the stress is increased specimen by specimen, a level is reached where centerline cracking initiates. At a higher stress level, specimen separation occurs . . . The general appearance of the cracking . . . [confirms] by the presence of a prior liquid film that the mechanism is classic hot cracking." This is a well known test and is further described in the examples and in the description of FIGS. 1 and 2.

These improved materials can be easily welded to each other, or to another superalloy, with an excellent bond and have excellent weldability properties for turbine vane and other stationary structural components for use in turbines, as evidenced by Sigmajig values of over 2× that of IN-939 Ni-base superalloys developed specifically for use in industrial and marine gas turbines. This improved weldability will lead to (1) cost savings by eliminating complex heat treatments that are currently used to allow casting repairs to be made, (2) product improvement by reducing weld defects in components that result from fabrication and repair and (3) time savings by simplifying fabrication welding. Improved weldability could also allow in-house component repair, rather than requiring use of advanced joining techniques that may be proprietary to specific vendors.

BRIEF DESCRIPTION OF THE DRAWINGS

For a better understanding of the invention, reference may be made to the accompanying drawings in which.

DESCRIPTION OF THE PREFERRED EMBODIMENTS

Figure 1:
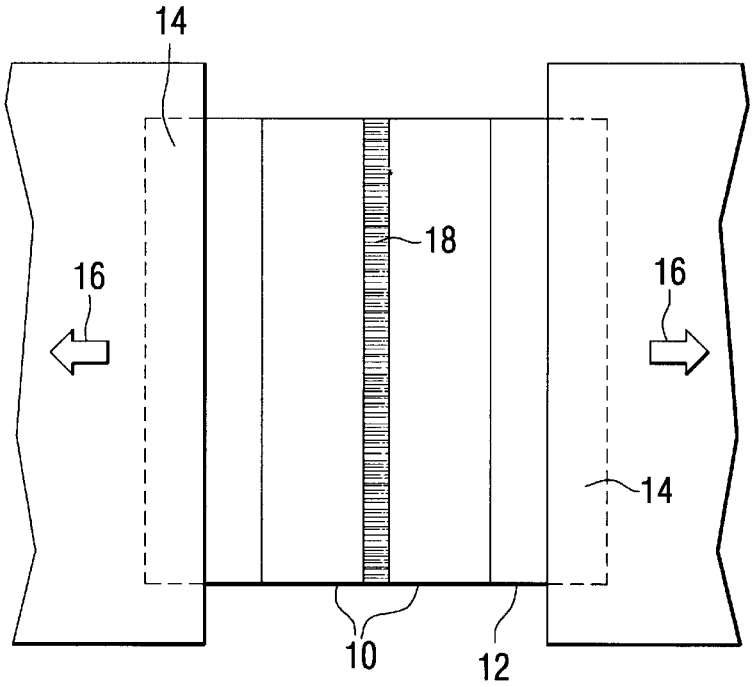
FIG. 1 is a schematic diagram showing a Sigmajig weldability test fixture.

The major components of the gas turbine are the inlet section through which air enters the gas turbine; a compressor section in which the entering air is compressed; a combustion section in which the compressed air from the compressor section is heated by burning fuel in combustors, thereby producing a hot compressed gas; a turbine section in which the hot compressed gas from the combustion section is expanded, thereby producing shaft torque; and an exhaust section through which the expanded gas is expelled to atmosphere.

The turbine section of the gas turbine is comprised of alternating rows of stationary vanes and rotating blades. Each row of vanes is arranged in a circumferential array around the rotor, as is well known in the art, and described in detail in U. S. Pat. No. 5,098,257 (Hultgren et al.).

Cast nickel based superalloys have generally been used in the hotter parts of the turbine section for the turbine vanes and blades. In the heat and corrosion intensive environment a number of physical properties must be met, such as thermal stability, adequate weldability, creep resistance, resistance to fatigue and the like and no one material possesses all these qualities. Improvement in one property usually results in less desirable values in one or more other properties, cobalt based superalloys have always had ease in repair welding but were susceptible to thermal fatigue. This invention provides modification to two minor components that may be used in many superalloys without modification to the major superalloy components so that the known properties of good creep resistance, high strength and corrosion resistance found in Ni-based superalloys is not disturbed, yet weldability is dramatically improved, allowing ease of fabrication and repair. Weldability has been improved through compositional changes in both Zr (zirconium) and B (boron). Both Zr and B must be present to provide the excellent improvement in weldability, up to 100%, or more, and maintain other important properties. Certain amounts of Zr and B must be present to improve grain boundary strength, creep strength and creep ductility. Zr is also believed to counteract the deleterious effect of any sulphur that might be present. The composition of these components is reduced in the Ni-based superalloy of this invention to from 0.005 wt % to 0.05 wt % Zr and from 0.001 wt % to 0.005 wt % B.

While not wishing to be held to any particular theory, the exact reason for such dramatic improvement in weldability is thought to be formation of an optimum amount of low melting constituents that helps heal the hot cracks in the weld fusion zone. Use of Zr and B together, within the above described ranges not only dramatically improves weldability but also provides superalloys with high temperature strength, ductility and significant resistance to oxidation and hot corrosion.

The following specific examples are presented to help illustrate the invention. They should not be considered in any way limiting.

EXAMPLES

The alloys, listed in the following Table, were made by standard arc melting, chill molding techniques described later. Sigmajig threshold cracking stresses $\sigma_0$ for these alloys are also given in Table 1; where the higher the cracking stress the better the weldability. All of the alloys were the same except for the concentration of Zr and B, and so are related to the IN-939 alloy referred to previously.

TABLE 1

| ALLOY: 1C = IN939 | | 2C | 3C | 4C | 5C | 6C | 7A | 8A | 9A | 10C | 11A | 12 | 13 | 14 | 15 | 16 | 17 |
|---|---|---|---|---|---|---|---|---|---|---|---|---|---|---|---|---|---|
| COMPONENT (Wt %) | | | | | | | | | | | | | | | | | |
| Cr | 22.5 | | | | | | S | A | M | E | | | | | | | |
| Co | 19.0 | | | | | | S | A | M | E | | | | | | | |
| Al | 1.9 | | | | | | S | A | M | E | | | | | | | |
| Ti | 3.7 | | | | | | S | A | M | E | | | | | | | |
| W | 2.0 | | | | | | S | A | M | E | | | | | | | |
| Ta | 1.4 | | | | | | S | A | M | E | | | | | | | |
| Nb | 1.0 | | | | | | S | A | M | E | | | | | | | |
| C | 0.15 | | | | | | S | A | M | E | | | | | | | |
| Zr | 0.1 | 1.0 | 1.0 | 0.1 | .01 | — | .005 | .008 | .008 | — | .005 | .008 | .01 | .02 | .015 | .01 | .015 |
| Hf | — | | | | | | S | A | M | E | | | | | | | |
| B | 0.01 | .01 | .002 | .002 | .01 | .002 | .002 | .001 | .002 | .01 | .005 | .005 | .001 | .002 | .002 | .002 | .005 |
| Ni | Bal. | Bal. | Bal. | Bal. | Bal. | Bal. | Bal. | Bal. | Bal. | Bal. | Bal. | Bal. | Bal. | Bal. | Bal. | Bal. | Bal. |
| Cracking Stress (Kpsi) | 10 | 9 | 11 | 15 | 18 | 20 | 21 | 22 | 22 | 23 | 25 | 27 | 27 | 27 | 27 | 28 | 28 |
| Total Zr + B (wt %) | 0.11 | 1.01 | 1.002 | .102 | .02 | .002 | .007 | .009 | .010 | .010 | .010 | .013 | .011 | .022 | .017 | .012 | .020 |

C = Comparative Alloy;
A = Acceptable Alloy But Not Preferred;
SAME = all samples had the same amount of Cr, Co, Al, Ti, W, Ta, Nb, C and Zr.
20 Kpsi = 20000 psi = 137.9 Newtons/sq. meter As can be seen from the data, Alloy Samples 12–17 provide very superior results in terms of weldability and are the preferred compositions, with Zr greater than 0.008% and B greater than 0.001%. They also can alloy with other Alloy Samples 7A, 8A, 9A and 11A, and provide acceptable results. Alloy Samples 7A, 8A, 9A and 11A provide acceptable results. They however do not have as good a weldability as the previous samples. Alloy Samples 6C and 10C do not contain Zr, so that while weldability results are acceptable, absence of Zr is considered unacceptable because of its detrimental effect on castability, grain boundary strengthening, and creep ductility. Samples 2C through 4C provide poor weldability. Sample 5C having a major amount of B does not improve weldability.

The Sigmajig hot cracking threshold stress ($\sigma_0$) is a value derived from the Sigmajig weldability test, which is well known and which was developed at Oak Ridge National Laboratory to quantitatively rank the relative weldabilities of those alloys that are prone to hot cracking. This test described in the literature by G. M. Goodwin in "Development of a New Hot Cracking Test—The Sigmajig", *Welding Journal Supplement,* 66(2), 33-s to 38-s (February 1987). The test involves application of a transverse stress, sigma (hence the name), to a rectangular specimen sheet, followed by autogenous gas tungsten arc welding. As the preapplied stress is increased, cracking eventually occurs.

Preliminary bead-on-plate autogenous welds on commercial IN-939 confirmed that the main mechanism of weld cracking was centerline hot cracking. The Sigmajig test is, therefore, an ideal test to investigate the effects of composition on weldability. In order to identify compositions that would improve weldability, the seventeen different alloys (compositions given in the Table) were arc-melted and drop cast into copper chill molds measuring 1.27×2.54×12.7 cm (0.5×1×5 in.). Cast specimens measuring 0.076×2.54×3.81 cm (0.030×1×1.5 in.) were electro-discharge machined (EDM) from each alloy. After the EDM specimens were polished with SiC paper, tabs measuring 0.076×1.27×3.81 cm (0.030×0.5×1.5 in.) were electron beam welded to each side of the specimen as shown in FIG. 1. The tabs 12 were made from a commercial IN-939 alloy, and they allowed the nickel-base superalloy specimens 10 to be gripped and tensile loaded during the Sigmajig test. The specimen 10 is one sheet, and the weld 18 is applied after gripping and stress 16 is applied. The gripping portion of the specimen is shown as 14 and the applied stress $\sigma$ as 16.

Figure 2:
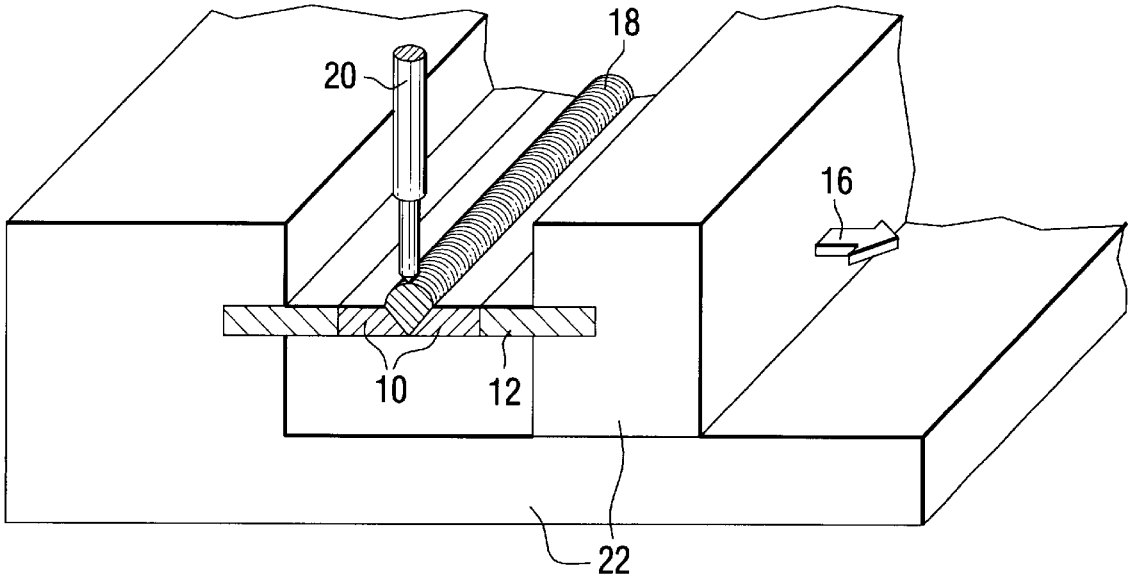
FIG. 2 is an overhead view of the specimen geometry for the Sigmajig weldability tests.

As further shown in FIG. 2, the Sigmajig test is a hot cracking test in which a transverse stress $\sigma$ shown as 16 is applied by a moveable fixture 22 to the sheet specimen 10 of the alloy, followed by autogenous gas tungsten arc (GTA) welding with a GTA torch 20 applied to the centerline 18. The welding parameters are: direct current electrode negative (DCEN); welding current of 68–78 Amps; welding speed of 76.2 cm/min.; arc length of 0.114 cm and an Argon gas flow rate of 0.425 cu. meters/hr (15 cu. ft./hr).

The magnitude of the transverse stress is increased progressively until a specimen cracks completely, that is, into two pieces. The stress at which such cracking occurs is called the threshold stress for hot cracking $\sigma_0$. Studies on stainless steels have shown that $\sigma_0$ can be used to quantitatively rank the weldabilities of different heats. In general, the higher the threshold stress, the better the weldability and bonding together of the two pieces. In this invention, components of this superalloy can be applied to a component of the same superalloy, or to another different superalloy.

What is claimed is:

1. A high temperature resistant nickel base superalloy composition containing small amounts of both boron and zirconium which are effective in combination to provide increased weldability, where the range of boron in the composition is from 0.001 wt % to 0.005 wt. % and the range of zirconium is from 0.005 wt % to 0.05 wt %, and where Zr+B is from 0.011 wt % to 0.06 wt %, also containing, by weight percent: 20.0%–25% Cr; up to 19.5% Co; 3.4%–4.0% Ti; 1.6%–2.2% Al; where Al+Ti is from 5.0%–6.2%, with the balance substantially Ni.

2. A turbine component made from the nickel-base superalloy of claim 1, welded to another superalloy.

3. The nickel-base superalloy of claim 1 also containing by weight %: 1.6%–2.4% W; 1.2%–1.6% Ta, 0.8%–1.2% Nb.

4. A turbine component made from the nickel-base superalloy of claim 1.

5. A turbine component made from the nickel-base superalloy of claim 4, welded to another superalloy.

6. The welded components of claim 5 having a Sigmajig transverse stress value greater than 137.9 million Newtons per square meter.

7. A cast, high temperature resistant, creep resistant, nickel-base superalloy consisting essentially of the composition by weight percent: 20.0%–25.0% Cr; up to 19.5% Co; 3.4%–4.0% Ti; 1.6%–2.2% Al; 1.6%–2.4% W; 1.2%–1.6% Ta; 0.8%–1.2% Nb; 0.005%–0.08% Zr; 0.001%–0.005% B; where Al+Ti is from 5.0%–6.2% and Zr+B is from 0.005% to 0.06% with the balance Ni.

8. A turbine component made from the nickel-base superalloy of claim 7.

9. A turbine component made from the nickel-base superalloy of claim 7, welded to another superalloy.

10. The welded components of claim 9 having a Sigmajig transverse stress value greater than 137.9 million Newtons per square meter.

* * * * *